US009458803B2

(12) United States Patent
Ueda et al.

(10) Patent No.: US 9,458,803 B2
(45) Date of Patent: Oct. 4, 2016

(54) CONSTRUCTION MACHINE

(71) Applicant: KOBELCO CONSTRUCTION MACHINERY CO., LTD., Hiroshima-shi (JP)

(72) Inventors: Yoshihiko Ueda, Hiroshima (JP); Masatoshi Kozui, Hiroshima (JP); Yae Tanbo, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 38 days.

(21) Appl. No.: 14/520,649

(22) Filed: Oct. 22, 2014

(65) Prior Publication Data

US 2015/0136057 A1 May 21, 2015

(30) Foreign Application Priority Data

Nov. 20, 2013 (JP) ..... 2013-239425

(51) Int. Cl.
*F02M 35/04* (2006.01)
*E02F 9/08* (2006.01)
(Continued)

(52) U.S. Cl.
CPC ..... *F02M 35/048* (2013.01); *E02F 9/0866* (2013.01); *F02M 35/0204* (2013.01); *F02M 35/044* (2013.01); *F02M 35/164* (2013.01)

(58) Field of Classification Search
CPC ..... F02D 2200/0812; F02D 29/00; F01N 13/0097; F01N 3/0211; F01N 2550/04; F02M 35/02; F02M 35/04; F02M 35/10032; F02M 35/10039; F02M 35/10288; F02M 35/104; F02M 35/161
USPC ..... 123/184.21, 198 E; 180/68.1–68.3, 180/69.24
See application file for complete search history.

(56) References Cited

U.S. PATENT DOCUMENTS

2002/0020157 A1* 2/2002 Hirano ..... B01D 46/24 55/385.3
2005/0211483 A1 9/2005 Pfohl et al.
(Continued)

FOREIGN PATENT DOCUMENTS

EP 2 615 211 A1 7/2013
JP 63-48965 U 4/1988
(Continued)

OTHER PUBLICATIONS

Extended European Search issued Apr. 1, 2015 in Patent Application No. 14190605.7.
(Continued)

*Primary Examiner* — Lindsay Low
*Assistant Examiner* — Long T Tran
(74) *Attorney, Agent, or Firm* — Oblon, McClelland, Maier & Neustadt, L.L.P.

(57) ABSTRACT

Provided is a construction machine including an air cleaner having a cylindrical outer peripheral surface and an air intake pipe, wherein the assembly of the air cleaner and the air intake pipe can have a reduced width size in the front-rear direction. The air intake pipe has a returning portion and a downstream-side portion. The downstream-side portion has a cross section having a shape including a hypotenuse portion inclined toward the air cleaner, arranged in the state where at least a part of the hypotenuse portion is located in a space defined between the cylindrical outer peripheral surface of the air cleaner and an air-cleaner placement surface.

5 Claims, 7 Drawing Sheets

(51) Int. Cl.
*F02M 35/16* (2006.01)
*F02M 35/02* (2006.01)

(56) References Cited

U.S. PATENT DOCUMENTS

| | | | | |
|---|---|---|---|---|
| 2009/0178880 | A1 | 7/2009 | Uemura et al. | |
| 2010/0275588 | A1* | 11/2010 | Kamata | B60K 5/1208 60/322 |
| 2011/0011377 | A1* | 1/2011 | Ikeda | F02M 26/24 123/568.12 |
| 2012/0192532 | A1* | 8/2012 | Muenkel | B01D 46/0021 55/356 |
| 2013/0174526 | A1 | 7/2013 | Watanabe et al. | |

FOREIGN PATENT DOCUMENTS

| | | | |
|---|---|---|---|
| JP | 3-63736 | U | 6/1991 |
| JP | 11-81378 | A | 3/1999 |
| JP | 2002-81320 | A | 3/2002 |
| JP | 2003-184670 | | 7/2003 |
| JP | 2013-142239 | A | 7/2013 |

OTHER PUBLICATIONS

Office Action issued Sep. 8, 2015 in Japanese Patent Application No. 2013-239425 (with English Summary).

* cited by examiner

CONSTRUCTION MACHINE

TECHNICAL FIELD

The present invention relates to a construction machine including an air cleaner, an engine, and an air intake pipe which interconnects the air cleaner and the engine.

BACKGROUND ART

There is conventionally known a construction machine including an engine, and an air cleaner having an exhaust port connected to the engine via an air intake pipe. Thus provided air cleaners for construction machines are disclosed in Japanese Utility Model Application Laid-open No. S63-48965 and Japanese Patent Application Laid-open No. 2003-184670.

There can be a case where the air cleaner has to be oriented so that an exhaust port of the air cleaner faces a side opposite to the engine for maintenance or the like. Furthermore, placement of the air cleaner within a limited space in the construction machine requires an assembly of the air cleaner and the air intake pipe connected to the air cleaner to have a reduced width size.

SUMMARY OF INVENTION

An object of the present invention is to provide a construction machine including an engine and an air cleaner which has an exhaust port and which is oriented so that the exhaust port faces to a side opposite to the engine, the construction machine being capable of having a reduced width size of an assembly of the air cleaner and an air intake pipe connected to the air cleaner.

Provided by the present invention is a construction machine including: an engine; an air cleaner having an exhaust port connected to the engine and having a cylindrical outer peripheral surface, the air cleaner configured to filter air taken in by the engine; and an air intake pipe interconnecting the exhaust port of the air cleaner and the engine. The air cleaner is placed in a posture where the exhaust port faces a side opposite to the engine. The air intake pipe includes a connection end portion to be connected to the exhaust port, a return portion having a shape extending from the connection end portion and returning toward the engine side, and an engine-side portion extending from a distal end of the return portion toward the engine along the air cleaner, thus forming a returning pipe at an exhaust side of the air cleaner. The air intake pipe has a downstream-side portion which is arranged so as to locate at least a part of the downstream-side portion in a space between the cylindrical outer peripheral surface of the air cleaner and a restriction surface extending in a tangent direction of the cylindrical outer peripheral surface to restrict a position of the air cleaner.

DESCRIPTION OF EMBODIMENTS

Figure 1:
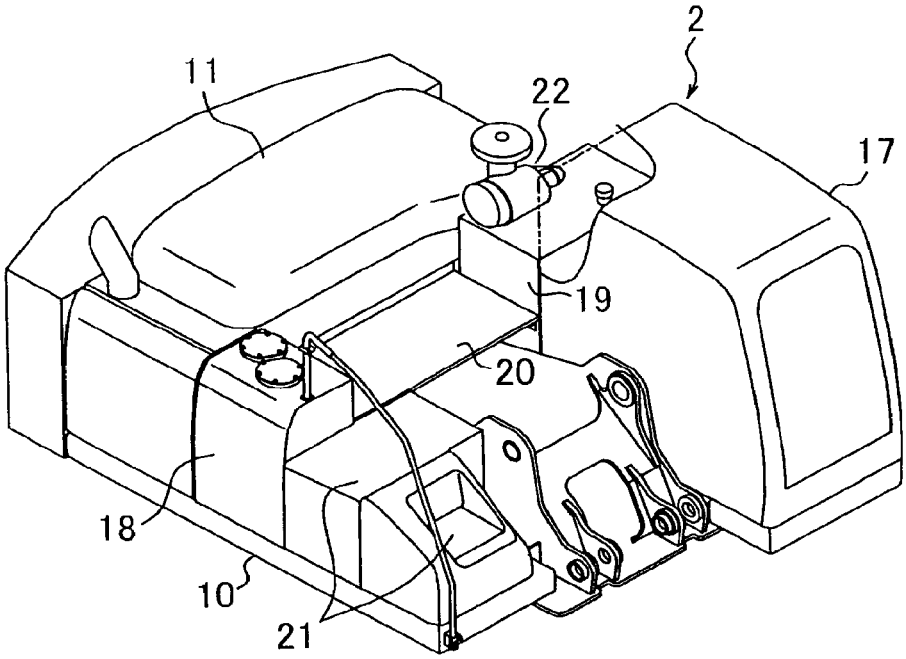
FIG. 1 is a perspective view of an upper slewing body of an excavator according to an embodiment of the present invention.
Figure 2:
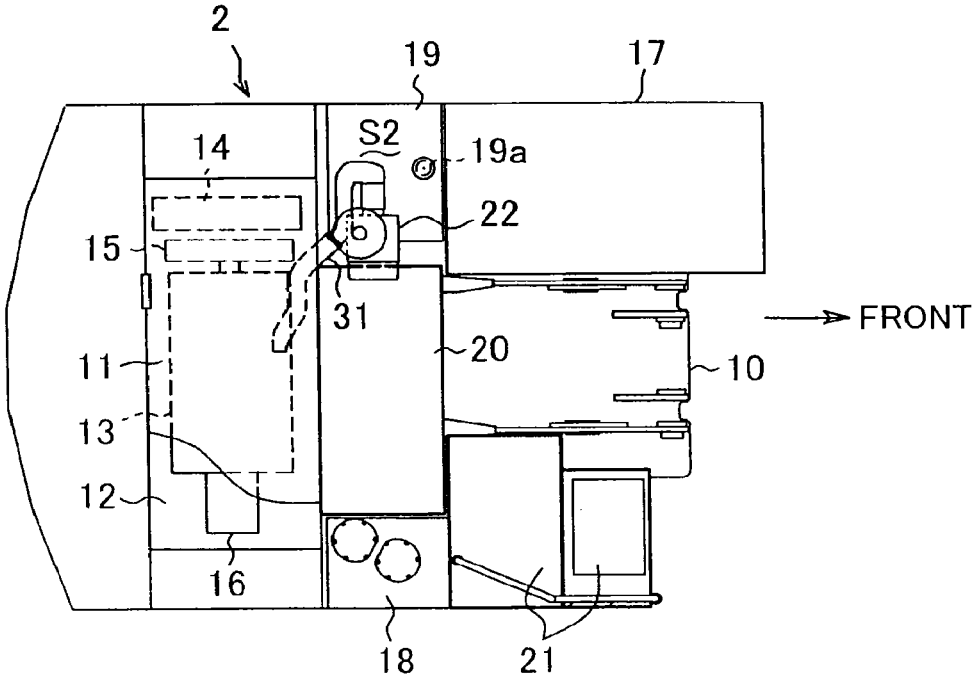
FIG. 2 is a plan view of the upper slewing body.
Figure 3:
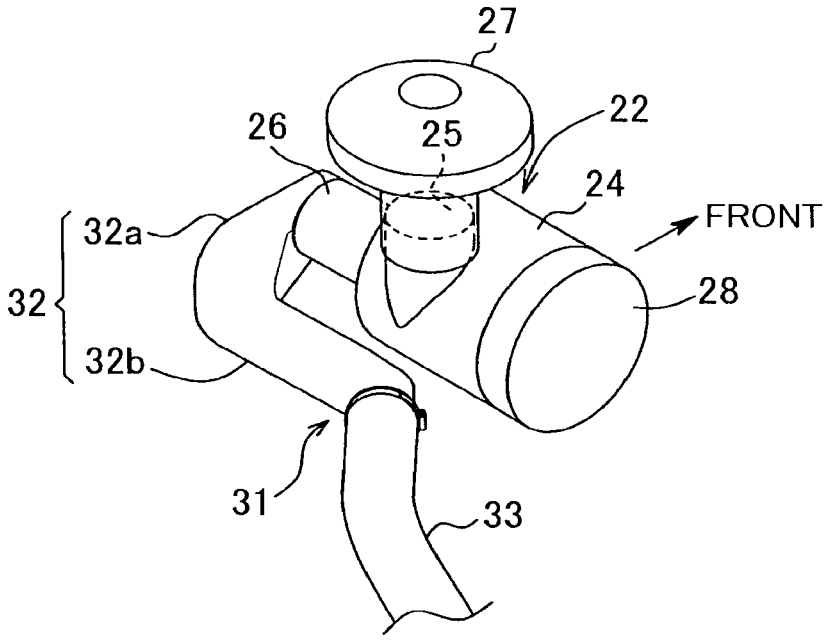
FIG. 3 is an enlarged view of an air cleaner of the excavator.

Embodiments of the present invention will be described. In advance of the description about the embodiments, explained is an excavator according to a comparative example virtually assumed for describing the embodiments, with reference to FIGS. 9 to 13.

The excavator includes a crawler-type lower travelling body 1, an upper slewing body 2 mounted on the lower travelling body 1 slewably about an axis perpendicular to the ground, and a working attachment 9 loaded on a front portion of the upper slewing body 2. The attachment 9 has a boom 3, an arm 4, a bucket 5, and a plurality of cylinders, namely, a boom cylinder 6, an arm cylinder 7 and a bucket cylinder 8, which operate the boom 3, the arm 4 and the bucket 5, respectively.

The upper slewing body 2 has an upper frame 10 as a base, and various devices and equipment which are mounted on the upper frame 10. Specifically, on the upper frame 10 are mounted an engine room 12 and a cabin 17. The engine room 12 is provided on a rear portion of the upper frame 10, having a bonnet 11 adapted to open and close an opening which faces upward. In the engine room 12, there are installed an engine 13 as a power source, and related devices of the engine 13, namely, a radiator 14, a cooling fan 15, a hydraulic pump 16, etc. The cabin 17 is installed forward of the engine room 12, and at one of right and left sides (usually, at the left side; hereinafter, the description will be based on this assumption). In the present specification, "front and rear" and "right and left" are directions from the viewpoint of an operator who is seated in the cabin 17.

Figure 10:
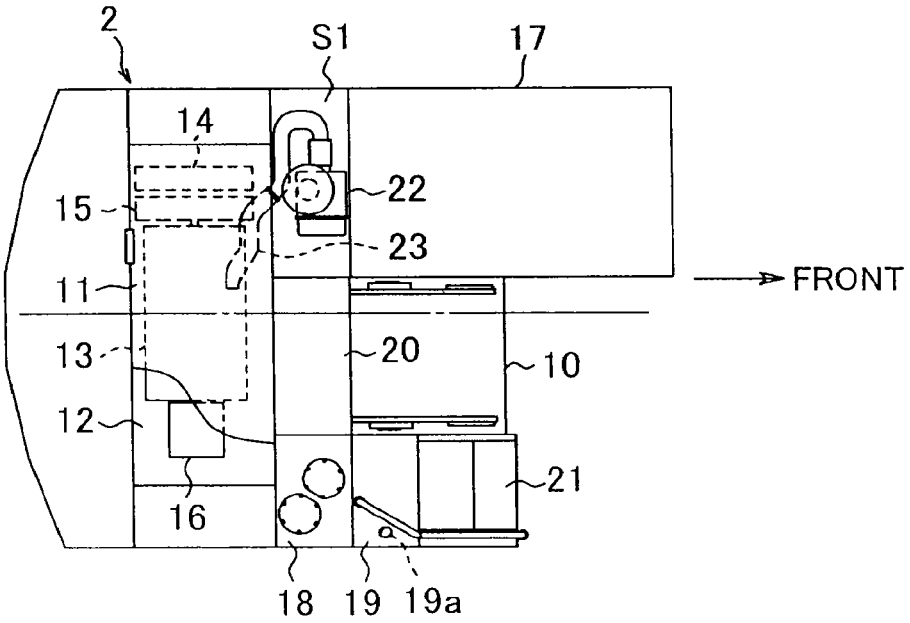
FIG. 10 is a schematic plan view of the excavator according to the comparison example.
Figure 11:
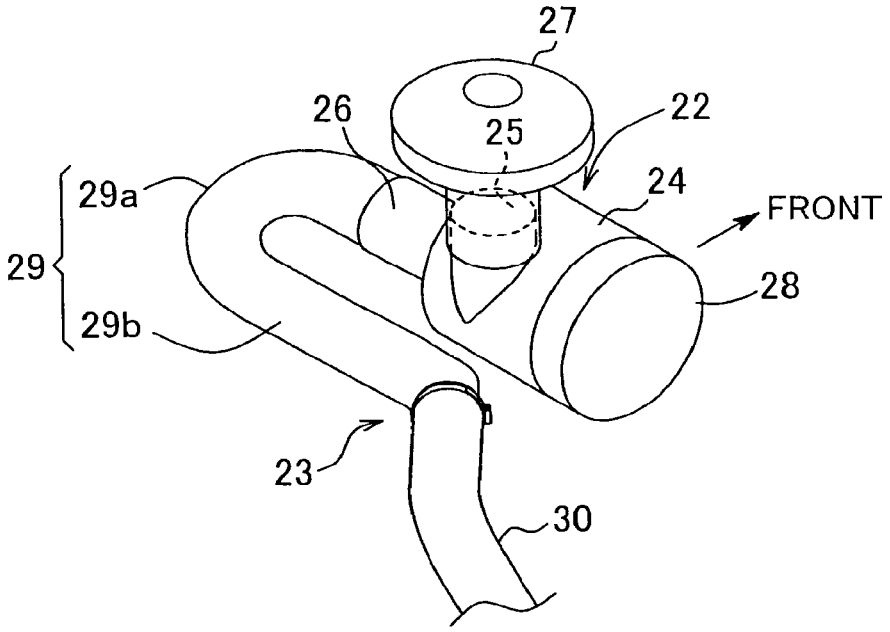
FIG. 11 is a perspective view of an air intake pipe and an air cleaner of the excavator according to the comparison example.

In the upper frame 10, there are further provided a hydraulic tank 18, a fuel tank 19, a center foothold 20, and a climbing step 21. The hydraulic tank 18 is placed on an opposite side to the cabin 17 with respect to the right and left direction (usually, at the right side) in the upper frame 10, and located forward of the engine room 12, and accumulates hydraulic fluid. The fuel tank 19 is arranged with the hydraulic tank 18 in the front and rear direction, and accumulates a fuel. The fuel tank 19 has an oil feeding portion 19*a*. The center foothold 20 is provided on a widthwise intermediate portion of the upper frame 10 immediately forward of the engine room 12, in order to allow maintenance of devices including the engine 13 in the engine room to be performed. The climbing step 21 is disposed forward of the fuel tank 19 and formed into a stair shape for guiding a maintenance person to the center foothold 20. Thus formed is a path for maintenance which reaches the center foothold 20 through the climbing step 21 and the upper surface of the fuel tank 19. FIG. 10 indicates a thick line surrounding the path and the center foothold 20 to distinguish them from other parts.

Over the upper frame 10, there are arranged an air cleaner 22 and an air intake piping 23. The air cleaner 22 is placed, for example, between the engine room 12 and the cabin 17 at the left side of the upper frame 10, in order to filter engine intake air. The air intake piping 23 interconnects the air cleaner 22 and an air suction port of the engine 13.

As shown in FIGS. 10 to 13, the air cleaner 22 has a cylindrical main body 24 inside which a filter is disposed, an air intake portion 25 which is protruded upward beyond the outer peripheral surface of the main body 24, a cylindrical exhaust portion 26 provided at one end side of the main body 24, and an end cover 28 provided at the other end side of the main body 24 and being detachable to take in and take out the filter not shown. An air intake cylinder 27 and an air intake pipe 23 are connected to the air intake portion 25 and the exhaust portion 26, respectively.

Figure 12:
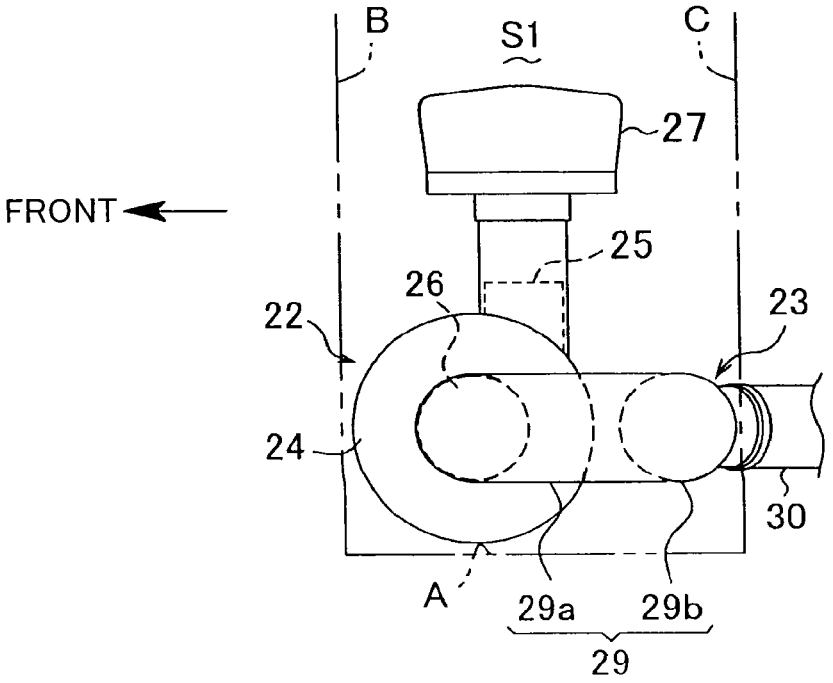
FIG. 12 is a left side view of the air intake pipe and the air cleaner shown in FIG. 11.

FIG. 12 shows a horizontal air-cleaner placement surface A on which the air cleaner 22 is placed, a front restriction surface B restricting a position of the air cleaner 22 on the front side thereof, for example, like the rear surface of the cabin 17, and a rear restriction surface C restricting a position of the air cleaner 22 on the rear side thereof, for example, like the front surface of the engine room 12. The position of the air cleaner 22 is thus restricted on both of the front and rear sides thereof by the front side restriction surface B and the rear side restriction surface C, respectively. In the case of providing a not-graphically-shown guard member which covers the air cleaner 22, there is a possibility that the front surface and the rear surface of the guard member correspond to the front side restriction surface B and the rear side restriction surface C, respectively. Besides, in the case of mounting the air cleaner 22 on the upper surface of the fuel tank via a seat plate, the upper surface of the seat plate corresponds to the air-cleaner placement surface A.

It is desirable to perform the maintenance of the air cleaner 22 (take-in and take-out of the filter) at the center foothold 20 from the aspect of working efficiency and safety; therefore, the air cleaner 22 is usually placed in a posture where the end cover 28 faces the center foothold 20 side while an exhaust port of the exhaust portion 26 faces the opposite side to the center foothold 20, i.e., to the outside of the machine body.

The air intake pipe 23 includes an air-cleaner-side pipe 29 and an engine-side pipe 30. The air-cleaner-side pipe 29 is arranged in an air cleaner installation space S1, having a basal end portion which is connected to the exhaust portion 26 of the air cleaner 22. The engine-side pipe 30 is arranged in the engine room 12 over substantially the whole length of the engine-side pipe 30, interconnecting the air-cleaner-side pipe 29 and the air intake port of the engine 13. Specifically, the engine-side pipe 30 has a distal end portion which is connected to the air intake port of the engine 13.

Since the exhaust port of the exhaust portion 26 of the air cleaner 22 is connected to the air-cleaner-side pipe 29 and faces the side opposite to the engine 13, the air-cleaner-side pipe 29 includes a returning portion 29*a* which returns in a U-shape as shown in the drawings. Across the returning portion 29*a*, an end portion at one side of the air-cleaner-side pipe 29 forms a basal end portion which is connected to the exhaust port of the exhaust portion 26 and an end portion at the other side of the air-cleaner-side pipe 29 forms the distal end portion which is connected to the engine-side pipe 30. Specifically, the air-cleaner-side pipe 29 includes the returning portion 29*a* and a straight-line portion 29*b* which extends horizontally and linearly from the distal end of the returning portion 29*a* to the engine 13 (the engine-side pipe 30) side along the air cleaner 22, at the side opposite to the basal end portion which is connected to the exhaust portion 26.

Figure 13:
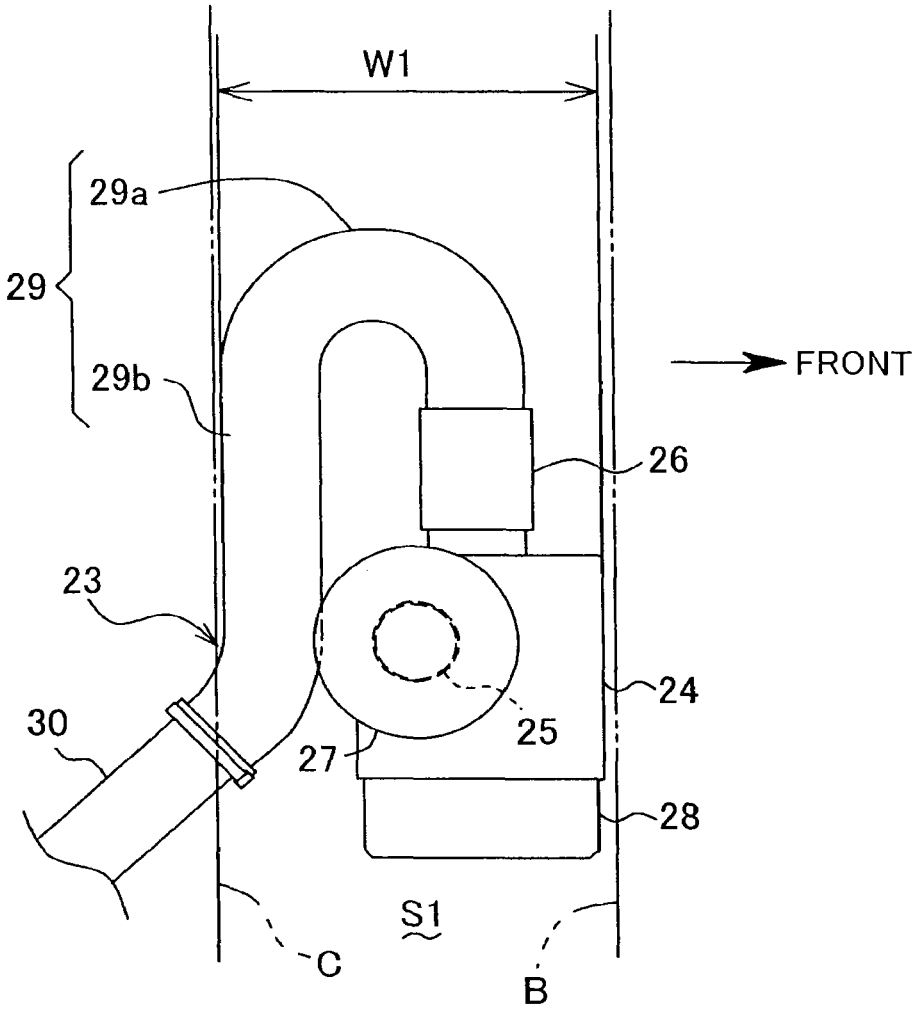
FIG. 13 is a plan view of the air intake pipe and the air cleaner shown in FIG. 11.

In the above structure, the sum of respective front-rear sizes of the air cleaner 22 and the air-cleaner-side pipe 29 is a width size W1 as shown in FIG. 13, the width size W1 being large. Hence, under the limitation of the front-rear size of the air cleaner installation space S1, the air cleaner 22 is hard to assembly. Otherwise, in order to facilitate the assembly, other space has to be decreased to increase the front-rear size of the air cleaner installation space S1.

If the air cleaner 22 was oriented so that the exhaust port of the air cleaner 22 faces the engine side, the width size W1 of the air cleaner could be reduced because of no need for the returning portion 29*a* of the air-cleaner-side pipe 29. This case, however, involves making the end cover 28 face the outside of the machine body, which requires the maintenance operation of taking in and taking out of the filter to be performed at a high place at the outside of the machine body: this is not advisable from the aspect of safety and working efficiency.

The excavator according to the embodiment of the present invention solves the above problems, while having a common configuration with the excavator according to the comparative example shown in FIGS. 10 to 13, in the following points.

Specifically, the excavator includes a not-graphically shown crawler-type lower travelling body, an upper slewing body 2 mounted on the lower travelling body 1 slewably about an axis perpendicular to the ground. The upper slewing body 2 has an upper frame 10 as a base, on which various devices and equipment are mounted. The various devices and equipment include an engine room 12, an engine 13 as a power source, related devices of the engine 13, a cabin 17, a plurality of tanks including a hydraulic oil tank 18 and a fuel tank 19, a center foothold 20, and a climbing step 21. The engine room 12 is provided in a rear portion of the upper frame 10, designed to be opened and closed by a bonnet 11. The engine 13 and the related devices are housed in the engine room 12. The related devices include a radiator 14, a cooling fan 15, and a hydraulic pump 16. The cabin 17 is installed at a position on a front side and the left side of the engine room 12. The hydraulic oil tank 18 is a tank which accumulates hydraulic oil. The hydraulic oil tank 18 is provided at a position on the opposite side to the cabin 17 with respect to the left and right direction in the upper frame 10, i.e., at the right side, and forward of the engine room 12. The center foothold 20 is used for maintenance of devices including the engine 13 in the engine room 12, and is provided immediately forward of the engine room 12 and at a widthwise intermediate part of the upper frame 10. The climbing step 21 is formed into a stair shape to guide the maintenance person to the center foothold 20, and is disposed forward of the hydraulic oil tank 18.

The fuel tank 19 is one for accumulating the fuel. In the present embodiment, the fuel tank 19 is placed in an installation space S2 defined between the cabin 17 and the engine room 12 over the upper frame 10, allowing an air cleaner 22 which filters the intake air of the engine to be placed on the fuel tank 19. In other words, while both of the hydraulic oil tank 18 and the fuel tank 19 in the comparative example shown in FIG. 10 are collected at the right side of the upper frame, the hydraulic oil tank 18 and the fuel tank 19 in the present embodiment are distributed on the right and left sides on the upper frame 10, respectively, and the air cleaner 22 is superposed on the fuel tank 19, that is, arranged three-dimensionally. The present arrangement enables an empty space forward of the hydraulic oil tank 18, that is, below the climbing step 21, to be produced, thus allowing other equipment (either one of or both of a liquid reducing-agent tank and a battery for hybrid machines, for example) to be installed in the produced space.

The fuel tank 19 has an oil feeding portion 19*a* being located at a front part of the fuel tank 19 and having an oil filling opening. The air cleaner 22 is placed at a rear part of the fuel tank 19, i.e., at a portion near the engine room, at a distance from the oil feeding portion 19*a*.

The air cleaner 22 has a configuration similar to that of the air cleaner 22 shown in FIGS. 10 to 13. Specifically, the air cleaner 22 shown in FIGS. 3 to 8 includes: a main body 24 accommodating a not-graphically-shown filter and having a cylindrical outer peripheral surface; an air intake portion 25 protruded upward beyond the outer peripheral surface of the main body 24 and having an air intake port; and an exhaust part 26 provided at one end side with respect to the axial direction of the main body 24 and having an exhaust port. An air intake cylinder 27 is connected to the air intake port, and an air intake pipe 31 is connected to the exhaust port. The air cleaner 22 includes an end cover 28, which is configured to be attached to and detached with respect to the other end side of the main body 24 for taking in and taking out the filter not shown to and from the main body 24.

Figure 4:
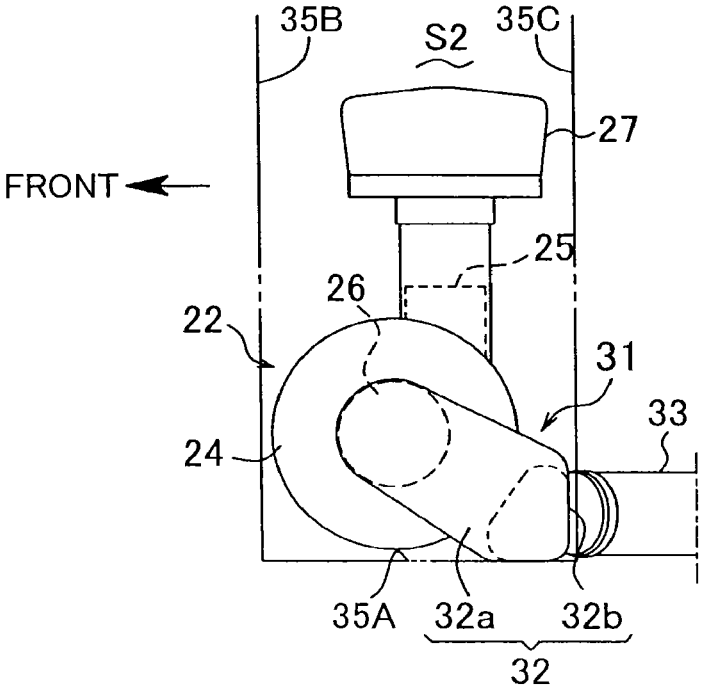
FIG. 4 is a left side view of the air cleaner.
Figure 6:
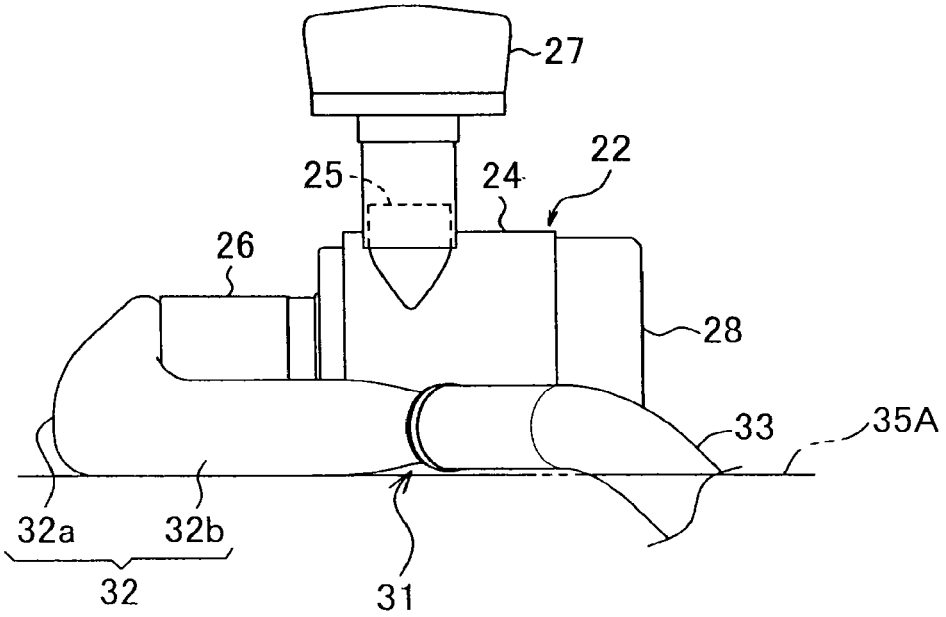
FIG. 6 is a rear view of the air cleaner.
Figure 7:
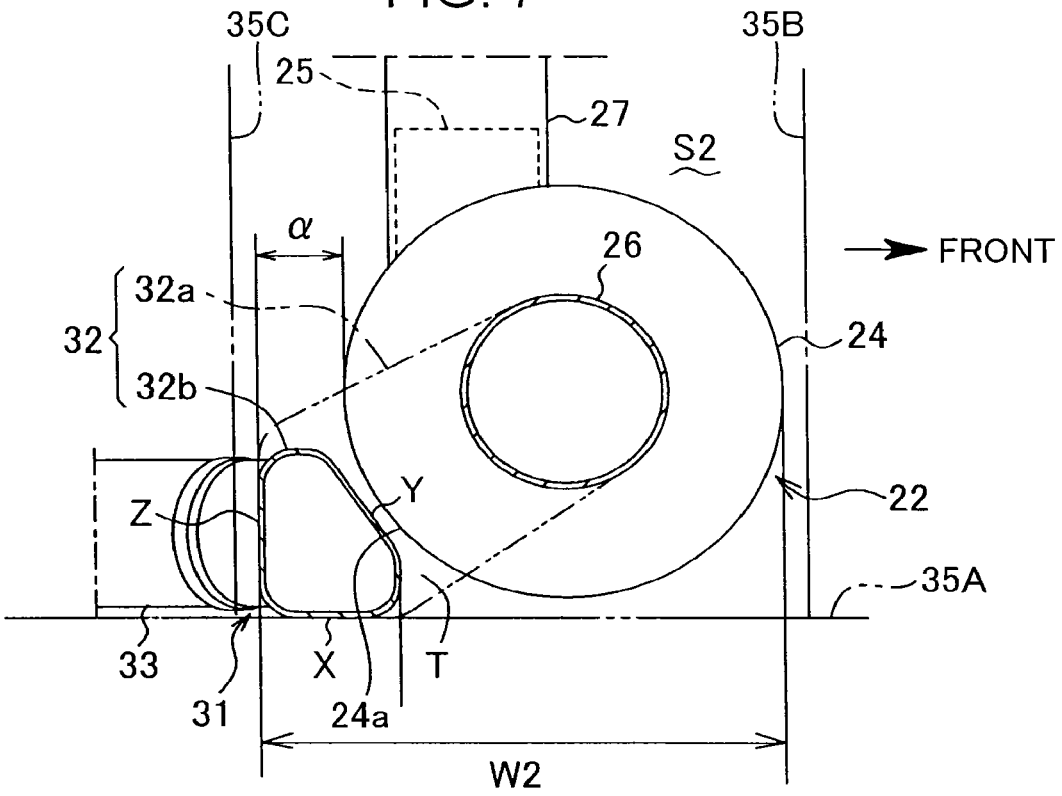
FIG. 7 is an enlarged view of a cross section along a line in FIG. 5.

In the present excavator, as a surface corresponding to "a restriction surface extending in a tangent direction of the cylindrical outer peripheral surface and restricting a position of the air cleaner", defined is an air-cleaner placement surface 35A shown in FIGS. 4, 6, and 7. The air-cleaner placement surface 35A is a horizontal surface, on which the air cleaner 22 is installed. Accordingly, in the case of mounting the air cleaner 22 onto the fuel tank 19, the upper surface of the fuel tank 19 corresponds to the air-cleaner placement surface 35A; in the case of mounting the air cleaner 22 through a plate-shaped seat plate, the upper surface of the seat plate corresponds to the air-cleaner placement surface 35A.

Figure 5:
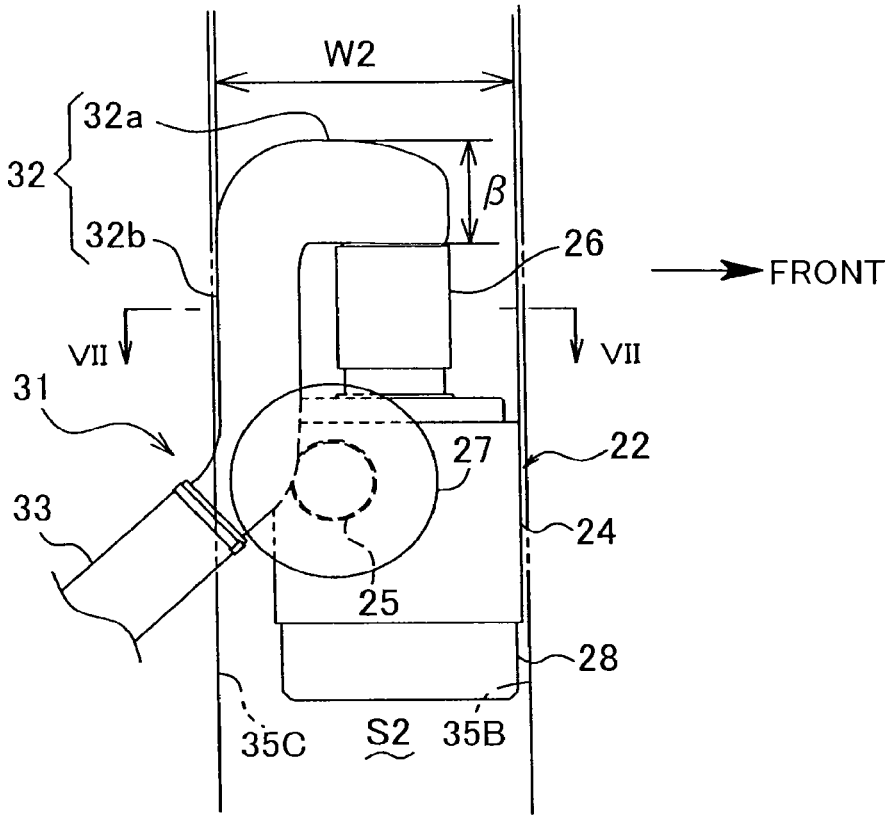
FIG. 5 is a plan view of the air cleaner.

Concerning the installation of the air cleaner 22, further defined are a front restriction surface 35B and a rear restriction surface 35C shown in FIGS. 4, 5, and 7. The front restriction surface 35B, which corresponds to a "sub-restriction surface", is a surface rising from the air-cleaner placement surface 35A substantially orthogonally to the air-cleaner placement surface 35A to restrict the position of the air cleaner 22 at the front side of the air cleaner 22. To the front restriction surface 35B, for example, the rear surface of the cabin 17 corresponds. The rear restriction surface 35C is a surface rising from the air-cleaner placement surface 35A substantially orthogonally to the air-cleaner placement surface 35A to restrict the position of the air cleaner 22 at the rear side of the air cleaner 22. To the rear restriction surface 35C, for example, the front surface of the engine room 12 corresponds. The air cleaner 22 is placed under the restriction of the position of the air cleaner 22 at respective front and rear sides thereof by the restriction surfaces 35B and 35C. In the situation of covering the air cleaner 22 with a not-graphically shown guard member, there can be a case where the front surface and the rear surface of the guard member correspond to the front side restriction surface and the rear side restriction surface, respectively.

It is desirable that the maintenance of the air cleaner 22, that is, take-in and take-out of the filter, is performed at the center foothold 20 for the sake of working efficiency and safety; therefore, the air cleaner 22 is placed so that the end cover 28 faces the center foothold 20 side and the exhaust port of the exhaust part 26 faces the opposite side, that is, the outside of the machine body.

The air intake pipe 31 has an air-cleaner-side pipe 32 and an engine-side pipe 33. The air-cleaner-side pipe 32 is arranged in the installation space S2, and has a basal end portion which is connected to the exhaust port of the exhaust part 26 of the air cleaner 22. The engine-side pipe 33 interconnects the air-cleaner-side pipe 32 and the air intake port of the engine 13. The engine-side pipe 33 is arranged so as to locate a portion of substantially the whole length thereof in the engine room 12. The engine-side pipe 33 has a distal end portion which is connected to the air intake port of the engine 13.

The exhaust port of the air cleaner 22, to which the distal end portion of the air-cleaner-side pipe 32 is connected, faces a side opposite to the engine 13: for the reason, the air-cleaner-side pipe 32 has a portion returning in a U-shape as shown in the drawings, wherein the basal end portion as one end portion out of the end portions at both sides of the returning portion is connected to the exhaust port of the exhaust part 26 while the distal end portion as the other end portion out of the end portions is connected to the engine-side pipe 33. In detail, the air-cleaner-side pipe 32 includes: the basal end portion which is connected to the exhaust port of the exhaust part 26; a returning portion 32*a* having a shape of returning so as to extend from the basal end portion to the outer peripheral side of the air cleaner 22 toward the engine 13 side; and a straight-line portion 32*b* as a downstream-side portion which extends from a distal end of the returning portion 32*a* along the air cleaner 22 linearly and horizontally to the engine 13 side, specifically, the engine-side pipe 30 side. The air-cleaner-side pipe 32 thus forms a pipe line returning in the U-shape to the exhaust side of the air cleaner 22.

The straight-line portion 32*b* of the air-cleaner-side pipe 32 has an approximately right-angled triangular cross section as shown in FIG. 7. The cross section has a horizontal bottom side part X, a hypotenuse portion Y, a vertical side part Z, and respective corner portions which connect mutually adjacent side parts, each corner portion being rounded.

The straight-line portion 32*b*, that is, the downstream-side portion, is arranged so as to satisfy the following conditions:

(I) the straight-line portion 32*b* is arranged in a corner region, which is defined between the air-cleaner placement surface 35A and the rear restriction surface 35C and located obliquely below the air cleaner 22 when the air cleaner 22 is viewed from the side;

(II) At least a part of the hypotenuse portion Y is located in a space T vertically sandwiched between a cylindrical outer peripheral surface 24*a* of the air cleaner main body 24 and the horizontal air-cleaner placement surface 35A as shown in FIG. 7; and (III) The vertical side portion Z is in contact with or adjacent to the rear restriction surface 35C while opposed to the rear restriction surface 35C.

The exhaust port of the exhaust portion 26 of the air cleaner 22 has a circular cross section, which requires a basal end portion 32*e* (FIG. 8) of the returning portion 32*a*, the basal end portion 32*e* adapted to be connected to the exhaust port, to have a circular cross section corresponding to the cross section of the exhaust port; meanwhile, the distal end portion of the returning portion 32*a*, joined to the straight-line portion 32*b*, is required to have a cross section which matches the cross section of the straight-line portion 32*b*, that is, the right-angled triangular cross section, shown in FIG. 7. However, sudden change in the shape of the cross section of the returning portion 32*a*, which has an original large airflow resistance due to the returning of the pipe line, from a circle to a right-angled triangle with an extreme reduction in the cross-sectional area involves a problem of excessively increasing the airflow resistance of the returning portion 32*a* to lower the aeration performance.

For the reason, the returning portion 32*a* according to the present embodiment is given a shape of the cross section which gradually changes from a circle to an approximately right-angled triangle by keeping a substantially constant area from the basal end portion 32*e* to the distal end portion of the returning portion 32*a*. Furthermore, the returning portion 32*a* does not have a simple are curved shape, but has a shape in which the basal end portion 32*e* opens toward the exhaust port of the exhaust portion 26 and the returning portion 32*a* linearly extends from the basal end portion 32*e* to the air cleaner outer peripheral side and reaches the straight-line portion 32*b*, as shown in the drawings.

The thus shaped air-cleaner-side pipe 32 can be manufactured as a molded product involving the integration of the returning portion 32*a* and the straight-line portion 32*b* with each other, by injection molding and the like using plastics and rubber as raw materials. Alternatively, the air-cleaner-side pipe 32 can be manufactured by casting using a metal material.

Figure 8:
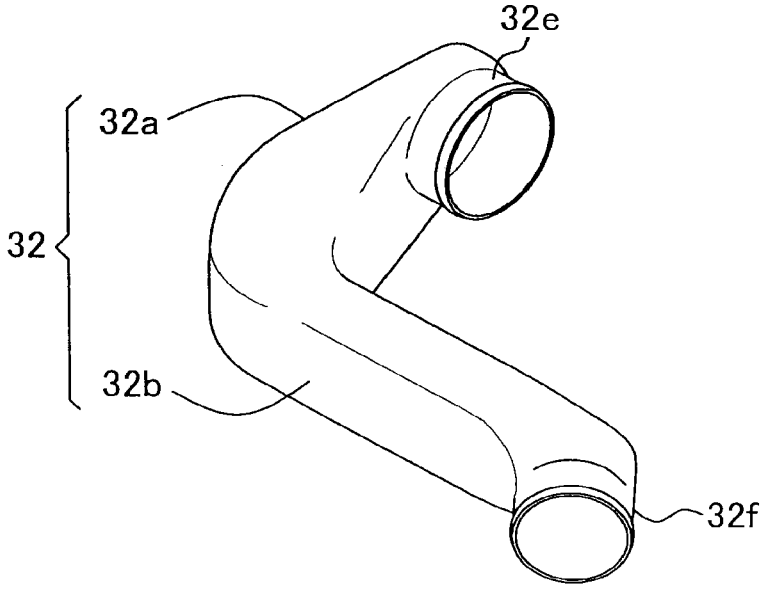
FIG. 8 is a perspective view of an air-cleaner-side pipe as a part of an air intake pipe in the excavator.
Figure 9:
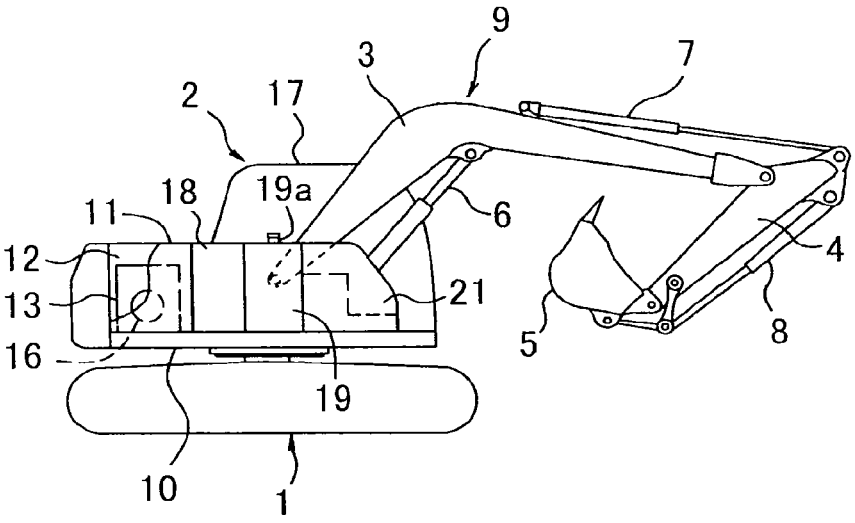
FIG. 9 is a schematic side view of an excavator according to a comparison example for explaining the present invention.

The straight-line portion 32*b* has a distal end portion 32*f* shown in FIG. 8. The distal end portion 32*f* is the opposite end portion to the returning portion 32*a*, connected to the engine-side pipe 33. The distal end portion 32*f* has a circular cross section corresponding to the circular cross section of the engine-side pipe 33. The distal end side of the straight-line portion 32*b*, originally having little bending and has small airflow resistance, is permitted to have a direct change in the shape of the cross section from an approximate triangle to a circle.

The present configuration enables the following effects to be obtained.

(1) The air intake pipe 31 has the air-cleaner-side pipe 32 which includes the returning portion 32*a* and the straight-line portion 32*b* as a downstream-side portion of the returning portion 32*a*, and the air intake pipe 31 is arranged so as to locate at least a part of the straight-line portion 32*b* in the space T vertically sandwiched between the cylindrical outer peripheral surface 24*a* of the air cleaner 22 and the air-cleaner placement surface 35A; this allows the width size W2 in the front-rear direction of the assembly of the air cleaner 22 and the air-cleaner-side pipe 32 to be reduced, for example, as compared with the case of locating the straight-line portion 32*b* at a position completely isolated from the space T. Furthermore, utilizing the space T, which is originally a dead space, as a part of the piping space of the straight-line portion 32*b* enables the space utilization efficiency to be enhanced.

(2) The space T in which at least a part of the straight-line portion 32*b* is located is positioned obliquely below the air cleaner 22 when the air cleaner 22 is viewed from the side, thus allowing a part of the straight-line portion 32*b* to be hidden under the air cleaner 22 when viewed from the above to reduce an exposed portion of the straight-line portion 32*b*. This enables the space utilization efficiency to be further enhanced.

(3) The straight-line portion 32*b*, having an approximately triangular cross section which includes the hypotenuse portion Y inclined toward the air cleaner 22 and arranged so as to locate at least a part of the hypotenuse portion Y in the space T, can have a small protrusion size α (SIG. 7) when the air cleaner 22 is viewed from the above by the insertion of a part of the straight-line portion 32*b* by a large depth. This allows the width size W2 in the front-rear direction of the assembly of the air cleaner 22 and the air-cleaner-side pipe 32 to be further reduced.

(4) The straight-line portion 32*b*, including the vertical side portion Z opposed to the rear restriction surface 35C, in addition to the hypotenuse portion Y, can have a cross section in the shape more similar to a triangle (a rectangular triangle), which allows the width size W2 of the assembly of the air cleaner 22 and the air-cleaner-side pipe 32 to be further reduced. This enables the straight-line portion 32*b* to be placed in compact without difficulty while being constrained within the corner region defined between the air-cleaner placement surface 35A and the rear restriction surface 35C, as in the above embodiment.

(5) The air-cleaner-side pipe 32, being an integrated molded product (a plastic injection molded product, for example), allows the width size W2 in the front-rear direction of the assembly of the air cleaner 22 and the air-cleaner-side pipe 32 to be reduced without difficulty, for example, as compared with an air-cleaner-side pipe made of a flexible hose and bent in a U-shape. Furthermore, the size β of the returning portion 32*a* in the air cleaner length direction shown in FIG. 5 also can be reduced without difficulty, which is particularly advantageous when the space for the air-cleaner-side pipe 32 is limited also in the air cleaner length direction.

The present invention is, however, not limited to the above-described embodiment but permitted include, for example, the following embodiments.

(a) The shape of the cross section of the downstream-side portion (the straight-line portion 32*b* in the above embodiment) of the air-cleaner-side pipe may be, for example, an approximate triangle having a vertical side portion Z and the bottom side portion X shown in FIG. 7 each formed in an arc-shape. This configuration also permits the above effects (1) to (3) to be obtained by the arrangement of the straight-line portion 32*b* with the insertion of at least a part of the hypotenuse portion Y into the space T.

(b) The air-cleaner-side pipe may have a circular cross section over a whole length of the air-cleaner-side pipe. This configuration also permits the above effects (1) and (2) to be obtained by the arrangement of the air-cleaner-side pipe with the insertion of at least a part of the downstream-side portion of the air-cleaner-side pipe into the space between the cylindrical outer peripheral surface of the air cleaner and the air-cleaner placement surface. In this case, the air-cleaner-side pipe 32 may be a flexible hose bent in a U-shape, instead of a plastic molded product and the like.

(c) While the air-cleaner placement surface 35A on which the air cleaner 22 is placed in the above embodiment is the upper surface of the fuel tank 19, the air-cleaner placement surface according to the present invention may be an upper surface of a hydraulic oil tank or an upper surface of an upper frame. The air cleaner, alternatively, may be suspended in a pre-defined specific space. Also in this case, the downstream-side portion only has to be arranged in the state where at least a part of the downstream-side portion is located in a space between an outer peripheral surface of the air cleaner and a restriction surface which is defined forward or rearward in the diameter direction of the air cleaner or above the air cleaner.

(d) The present invention can be applied to not only an excavator but also various construction machines configured by utilization of the excavator, similarly to the above embodiments.

As described above, the present invention provides a construction machine including an engine and an air cleaner which has an exhaust port and which is oriented so that the exhaust port faces a side opposite to the engine, the construction machine being capable of having a reduced width size of an assembly of the air cleaner and an air intake pipe connected to the air cleaner. The provided construction machine includes: an engine; an air cleaner having an exhaust port connected to the engine and having a cylindrical outer peripheral surface, the air cleaner configured to filter air taken in by the engine; and an air intake pipe interconnecting the exhaust port of the air cleaner and the engine. The air cleaner is placed in a posture where the exhaust port faces a side opposite to the engine. The air intake pipe includes a connection end portion to be connected to the exhaust port, a return portion having a shape extending from the connection end portion and returning toward the engine side, and an engine-side portion extending from a distal end of the return portion toward the engine along the air cleaner, thus forming a returning pipe at an exhaust side of the air cleaner. The air intake pipe has a downstream-side portion which is arranged so as to locate at least a part of the downstream-side portion in a space between the cylindrical outer peripheral surface of the air cleaner and a restriction surface extending in a tangent direction of the cylindrical outer peripheral surface to restrict a position of the air cleaner.

According to the present construction machine, the air intake pipe including the returning portion and the downstream-side portion is arranged in the state where at least a part of the downstream-side portion is located in the space between the cylindrical outer peripheral surface of the air cleaner and the restriction surface extending in the tangent direction of the cylindrical outer peripheral surface, thus enabling the width size in the front-rear direction of an air intake section, assembly of the air intake pipe and the air cleaner, to be reduced, for example, as compared with the case of arranging the air intake pipe at a position where the downstream-side portion thereof is completely isolated from the space. Furthermore, utilizing the space, which is originally a dead space, as a part of the space for piping of the downstream-side portion allows the space utilization efficiency to be enhanced.

It is desirable that: the restriction surface is, for example, a horizontal air-cleaner placement surface on which the air cleaner is placed; and the downstream-side portion is arranged in a space formed between the outer peripheral surface of the air cleaner and the air-cleaner placement surface obliquely below the air cleaner when the air cleaner is viewed from the side. The thus placed downstream-side portion allows at least a part thereof to be hidden under the air cleaner when viewed from the above, that is, allows an upwardly exposed portion thereof to be small, thereby enabling the space utilization efficiency to be particularly enhanced.

In this case, it is more desirable that: the downstream-side portion of the air intake pipe has an approximately triangular cross section including a hypotenuse portion inclined toward the air cleaner; and the downstream-side portion is arranged so as to locate at least a part of the hypotenuse portion in the space. This enables a depth in which the downstream-side portion is inserted into the space to be increased and thus enables a protrusion size of the downstream-side portion when the air cleaner is viewed from the above to be made small, thereby allowing the width size in the front-rear direction of the assembly of the air cleaner and the air intake pipe to be further reduced.

In addition to the restriction surface as the air-cleaner placement surface, there may be defined a sub-restriction surface which restricts the position of the air cleaner and is substantially orthogonal with the air-cleaner placement surface: in this case, it is more desirable that the cross section of the downstream-side portion of the air intake pipe has an approximately triangular shape including a side portion opposed to the sub-restriction surface, in addition to the hypotenuse portion. The cross section of the thus shaped downstream-side portion can have a shape close to a right-angled triangle, thereby allowing the width size in the front-rear direction of the assembly of the air cleaner and the air intake pipe to be smaller. The downstream-side portion is thus permitted to be arranged in compact without difficulty in a corner region defined between the air-cleaner placement surface as the restriction surface and the sub-restriction surface which is substantially orthogonal with the air-cleaner placement surface.

It is desirable that: the air intake pipe has an air-cleaner-side pipe including the returning portion and the downstream-side portion and an engine-side pipe which interconnects the air-cleaner-side pipe and the engine; and the air-cleaner-side pipe is a molded product (for example, a plastic injection molded product) involving integration of the returning portion and the downstream-side portion with each other. The air-cleaner-side pipe allows the width size in the front-rear direction of the assembly of the air-cleaner-side pipe and the air cleaner to be small without difficulty, for example, as compared with a width size of a flexible hose bent in a U-shape. Furthermore, it is also possible to reduce a protrusion size of the returning portion in the air cleaner length direction, which is particularly advantageous when a space is also limited in the air cleaner length direction.

This application is based on Japanese Patent application No. 2013-239425 filed in Japan Patent Office on Nov. 20, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A construction machine comprising:

an engine;

an air cleaner having an exhaust port connected to the engine and having a cylindrical outer peripheral surface, the air cleaner configured to filter air taken in by the engine; and an air intake pipe interconnecting the exhaust port of the air cleaner and the engine, wherein:

the air cleaner is placed in a posture where the exhaust port faces a side of the construction machine opposite to the location of the engine;

the air intake pipe includes a connection end portion to be connected to the exhaust port, a return portion having a shape extending from the connection end portion and returning toward the engine side, and an engine-side portion extending from a distal end of the return portion toward the engine along the air cleaner, thus forming a returning pipe at an exhaust side of the air cleaner; and the air intake pipe has a downstream-side portion which is arranged so as to locate at least a part of the downstream-side portion in a space vertically sandwiched between the cylindrical outer peripheral surface of the air cleaner and a restriction surface extending in a tangent direction of the cylindrical outer peripheral surface to restrict a position of the air cleaner, wherein the restriction surface is a horizontal air-cleaner placement surface, on which the air cleaner is placed.

2. The construction machine according to claim 1, wherein:

the downstream-side portion is arranged in a space defined between the outer peripheral surface of the air cleaner and the air-cleaner placement surface obliquely below the air cleaner when the air cleaner is viewed from the side.

3. The construction machine according to claim 1, wherein:

the air intake pipe has an air-cleaner-side pipe including the returning portion and the downstream-side portion, and an engine-side pipe which interconnects the air-cleaner-side pipe and the engine; and the air-cleaner-side pipe is a molded product involving integration of the returning portion and the downstream-side portion with each other.

4. A construction machine comprising:

an engine;

an air cleaner having an exhaust port connected to the engine and having a cylindrical outer peripheral surface, the air cleaner configured to filter air taken in by the engine; and an air intake pipe interconnecting the exhaust port of the air cleaner and the engine, wherein:

the air cleaner is placed in a posture where the exhaust port faces a side of the construction machine opposite to the location of the engine;

the air intake pipe includes a connection end portion to be connected to the exhaust port, a return portion having a shape extending from the connection end portion and returning toward the engine side, and an engine-side portion extending from a distal end of the return portion toward the engine along the air cleaner, thus forming a returning pipe at an exhaust side of the air cleaner; and the air intake pipe has a downstream-side portion which is arranged so as to locate at least a part of the downstream-side portion in a space between the cylindrical outer peripheral surface of the air cleaner and a restriction surface extending in a tangent direction of the cylindrical outer peripheral surface to restrict a position of the air cleaner, wherein the restriction surface is a horizontal air-cleaner placement surface, on which the air cleaner is placed, wherein the downstream-side portion is arranged in a space defined between the outer peripheral surface of the air cleaner and the air-cleaner placement surface obliquely below the air cleaner when the air cleaner is viewed from the side, wherein:

the downstream-side portion of the air intake pipe has an approximately triangular cross section including a hypotenuse portion inclined toward the air cleaner; and the downstream-side portion is arranged so as to locate at least a part of the hypotenuse portion in the space.

5. The construction machine according to claim 4, wherein:

a sub-restriction surface which restricts a position of the air cleaner and is substantially orthogonal with the air-cleaner placement surface is further defined in addition to the restriction surface; and a cross section of the downstream-side portion of the air intake pipe has an approximately triangular shape including a side portion opposed to the sub-restriction surface, in addition to the hypotenuse portion.

* * * * *